US009071919B2

(12) United States Patent
Shim et al.

(10) Patent No.: US 9,071,919 B2
(45) Date of Patent: Jun. 30, 2015

(54) APPARATUS AND METHOD FOR ENCODING AND DECODING SPATIAL PARAMETER

(75) Inventors: Hwan Shim, Yongin-si (KR); Eun-Mi Oh, Seoul (KR); Mi-Young Kim, Hwaseong-si (KR); Anton V. Porov, Yongin-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 604 days.

(21) Appl. No.: 13/271,792

(22) Filed: Oct. 12, 2011

(65) Prior Publication Data

US 2012/0093321 A1 Apr. 19, 2012

(30) Foreign Application Priority Data

Oct. 13, 2010 (KR) ..... 10-2010-0100001

(51) Int. Cl.
*H04R 5/00* (2006.01)
*H04S 1/00* (2006.01)

(52) U.S. Cl.
CPC ..... *H04S 1/007* (2013.01); *H04S 2400/03* (2013.01); *H04S 2420/03* (2013.01)

(58) Field of Classification Search
CPC ..... H04R 5/00; G10L 19/00
USPC ..... 381/17, 22–23; 704/230, 500, E19.001
See application file for complete search history.

(56) References Cited

U.S. PATENT DOCUMENTS

| | | | | |
|---|---|---|---|---|
| 8,054,981 | B2 * | 11/2011 | Roden et al. | 381/23 |
| 8,090,587 | B2 * | 1/2012 | Jung et al. | 704/500 |
| 8,255,228 | B2 * | 8/2012 | Hilpert et al. | 704/500 |
| 8,484,021 | B2 * | 7/2013 | Kim et al. | 704/229 |
| 8,588,440 | B2 * | 11/2013 | Koppens et al. | 381/310 |
| 2007/0016416 | A1 * | 1/2007 | Roden et al. | 704/230 |
| 2009/0110203 | A1 * | 4/2009 | Taleb | 381/17 |
| 2011/0257968 | A1 * | 10/2011 | Kim et al. | 704/230 |

FOREIGN PATENT DOCUMENTS

| | | |
|---|---|---|
| JP | 10-2008-0030848 | 4/2008 |
| JP | 2009-163257 | 7/2009 |
| KR | 10-2007-0011136 | 1/2007 |
| WO | 2008/046531 A1 | 4/2008 |

* cited by examiner

*Primary Examiner* — Disler Paul
(74) *Attorney, Agent, or Firm* — Staas & Halsey LLP

(57) ABSTRACT

An apparatus and method for encoding and decoding a spatial parameter are provided. A spatial parameter encoding apparatus may encode a spatial parameter using a correlation between spatial parameters indicating a characteristic relationship between channels of a multi-channel audio signal, so that the multi-channel audio signal may be efficiently encoded.

26 Claims, 9 Drawing Sheets

APPARATUS AND METHOD FOR ENCODING AND DECODING SPATIAL PARAMETER

CROSS-REFERENCE TO RELATED APPLICATIONS

This application claims the priority benefit of Korean Patent Application No. 10-2010-0100001, filed on Oct. 13, 2010, in the Korean Intellectual Property Office, the disclosure of which is incorporated herein by reference.

BACKGROUND

1. Field

Embodiments of the following description relate to a spatial parameter encoding apparatus and method, and a spatial parameter decoding apparatus and method. More particularly, embodiments of the following description relate to an apparatus and method for encoding and decoding a spatial parameter using a correlation between spatial parameters.

2. Description of the Related Art

Generally, a scheme of encoding a multi-channel audio signal includes waveform multi-channel audio coding, and parametric multi-channel audio coding. Here, the multi-channel audio signal refers to a signal with at least two channels.

The waveform multi-channel audio coding typically includes, for example, Moving Picture Experts Group (MPEG)-2 multi-channel audio coding, Advanced Audio Coding (AAC) multi-channel audio coding, and BSAC (Bit-sliced arithmetic coding)/AVS (Audio Video Standard) multi-channel audio coding. Additionally, the parametric multi-channel audio coding typically includes MPEG surround coding.

In particular, in the MPEG surround coding, a multi-channel audio signal may be restored using a signal obtained by down-mixing the multi-channel audio signal, and using a spatial parameter indicating a characteristic relationship between channels. Phase difference information among spatial parameters may be used to improve spatiality of an audio signal, however, may not be used to reduce a bit amount at a low bit rate. A bit amount of a spatial parameter may also be reduced by adjusting a quantization level, however, a sound quality may be degraded.

Accordingly, there is a desire for a method of improving a spatiality based on a low bit rate, even when a small amount of spatial parameters is used.

SUMMARY

According to an aspect of one or more embodiments, there is provided a spatial parameter encoding apparatus including a valid range determination unit to determine a valid range of a spatial parameter using a correlation between spatial parameters indicating a characteristic relationship between channels of a multi-channel audio signal, a parameter quantization unit to quantize the spatial parameter based on the valid range, and a parameter encoding unit to encode the quantized spatial parameter using at least one processor.

According to an aspect of one or more embodiments, there is provided a spatial parameter decoding apparatus including a spatial parameter decoding unit to decode an encoded spatial parameter, a valid range determination unit to determine a valid range of a spatial parameter using a correlation between spatial parameters indicating a characteristic relationship between channels of a multi-channel audio signal, and a parameter dequantization unit to dequantize the spatial parameter based on the valid range using at least one processor.

According to an aspect of one or more embodiments, there is provided a spatial parameter encoding method including determining a valid range of a spatial parameter using a correlation between spatial parameters indicating a characteristic relationship between channels of a multi-channel audio signal, quantizing the spatial parameter based on the valid range, and encoding the quantized spatial parameter using at least one processor.

According to an aspect of one or more embodiments, there is provided a spatial parameter decoding method including decoding an encoded spatial parameter, determining a valid range of a spatial parameter using a correlation between spatial parameters indicating a characteristic relationship between channels of a multi-channel audio signal, and dequantizing the spatial parameter based on the valid range using at least one processor.

According to another aspect of one or more embodiments, there is provided at least one computer readable medium storing computer readable instructions to implement methods of one or more embodiments.

According to one ore more embodiments, it is possible to efficiently encode a spatial parameter by removing invalid parameter information using a correlation between spatial parameters.

Additionally, according to one or more embodiments, it is possible to improve a spatiality even using a spatial parameter with a low bit rate, based on a correlation between spatial parameters.

BRIEF DESCRIPTION OF THE DRAWINGS

These and/or other aspects will become apparent and more readily appreciated from the following description of embodiments, taken in conjunction with the accompanying drawings of which.

DETAILED DESCRIPTION

Figure 1:
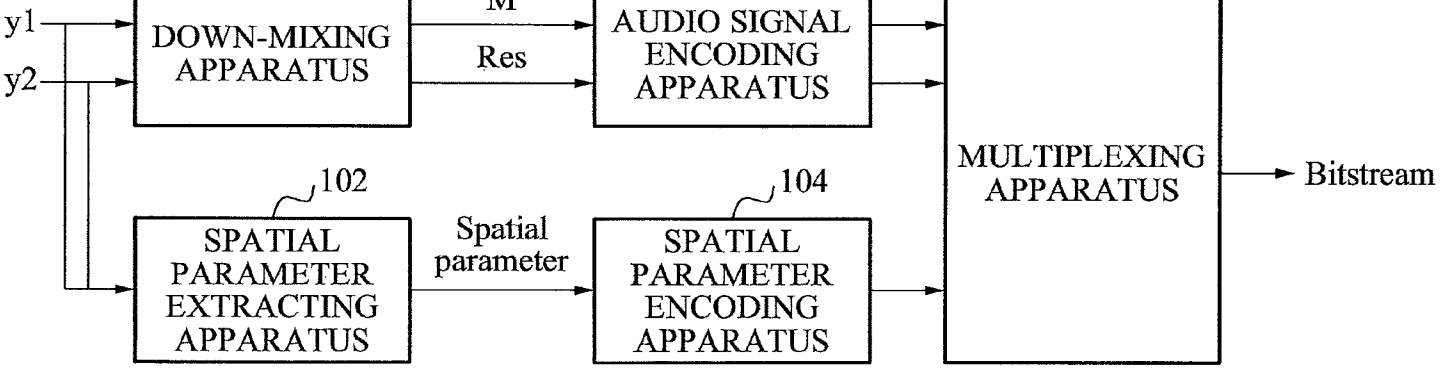
FIG. 1 illustrates a block diagram of apparatuses used to encode a multi-channel audio signal according to one or more embodiments.

Reference will now be made in detail to embodiments, examples of which are illustrated in the accompanying drawings, wherein like reference numerals refer to the like elements throughout. Embodiments are described below to explain the present disclosure by referring to the figures.

FIG. 1 illustrates a block diagram of apparatuses used to encode a multi-channel audio signal according to one or more embodiments.

Referring to FIG. 1, the multi-channel audio signal may be encoded through a down-mixing apparatus 101, a spatial parameter extracting apparatus 102, an audio signal encoding apparatus 103, a spatial parameter encoding apparatus 104, and a multiplexing apparatus 105. The encoded multi-channel audio signal may be provided as a bitstream.

The down-mixing apparatus 101 may generate a main signal by down-mixing the input multi-channel audio signal. For example, the down-mixing apparatus 101 may down-mix a stereo signal with two channels, to generate a mono signal with a single channel. In other words, the mono signal may be used as the main signal. In an example of a Moving Picture Experts Group (MPEG) surround coding, a tree structure is formed using an apparatus (2-1-2) for coding a stereo signal as illustrated in FIG. 1, and the multi-channel audio signal with at least two channels may be coded.

The spatial parameter extracting apparatus 102 may extract a spatial parameter indicting a characteristic relationship between channels of the multi-channel audio signal. For example, the spatial parameter may include at least one of an Inter-channel Intensity Difference (IID), a Channel Level Difference (CLD), an Inter-Channel Correlation (ICC) based on a similarity of waveforms of channels, an Inter-channel Phase Difference (IPD), an Inter Time Difference (ITD), and an Overall Phase Difference (OPD). Here, the IID or the CLD may indicate an intensity difference based on an energy level between channels, and the OPD may indicate how a phase difference between two channels is distributed based on a mono signal.

The spatial parameter may be determined based on a condition of the following Equation 1:

$$\begin{bmatrix} L \\ R \end{bmatrix} = \begin{bmatrix} H11^{l,m}_{OTT_x} & H12^{l,m}_{OTT_x} \\ H21^{l,m}_{OTT_x} & H22^{l,m}_{OTT_x} \end{bmatrix} \begin{bmatrix} M \\ D \end{bmatrix} \quad \text{[Equation 1]}$$

In Equation 1, M denotes a down-mix signal, and D denotes a decorrelated signal of the down-mix signal.

$$\begin{bmatrix} H11^{l,m}_{OTT_X} & H12^{l,m}_{OTT_X} \\ H21^{l,m}_{OTT_X} & H22^{l,m}_{OTT_X} \end{bmatrix} = \begin{cases} \begin{bmatrix} e^{-j\theta_1^{n,K(k)}} & 0 \\ 0 & e^{-j\theta_2^{n,K(k)}} \end{bmatrix} \begin{bmatrix} c^{l,m}_{1,X}\cos(\alpha^{l,m}_X + \beta^{l,m}_X) & 1 \\ c^{l,m}_{2,X}\cos(-\alpha^{l,m}_X + \beta^{l,m}_X) & -1 \end{bmatrix}, & m < resBands_X \\ \begin{bmatrix} e^{-j\theta_1^{n,K(k)}} & 0 \\ 0 & e^{-j\theta_2^{n,K(k)}} \end{bmatrix} \begin{bmatrix} c^{l,m}_{1,X}\cos(\alpha^{l,m}_X + \beta^{l,m}_X) & c^{l,m}_{1,X}\sin(\alpha^{l,m}_X + \beta^{l,m}_X) \\ c^{l,m}_{2,X}\cos(-\alpha^{l,m}_X + \beta^{l,m}_X) & c^{l,m}_{2,X}\sin(-\alpha^{l,m}_X + \beta^{l,m}_X) \end{bmatrix}, & \text{otherwise} \end{cases}$$

$$\text{where, } c^{l,m}_{1,X} = \sqrt{\frac{10^{\frac{CLD^{l,m}_X}{10}}}{1 + 10^{\frac{CLD^{l,m}_X}{10}}}},\ c^{l,m}_{2,X} = \sqrt{\frac{1}{1 + 10^{\frac{CLD^{l,m}_X}{10}}}}$$

$$\alpha^{l,m}_X = \frac{1}{2}\arccos(\rho^{l,m}_X),\ \beta^{l,m}_X = \arctan\left(\tan(\alpha^{l,m}_X)\frac{c^{l,m}_{2,X} - c^{l,m}_{1,X}}{c^{l,m}_{2,X} + c^{l,m}_{1,X}}\right)$$

$$\rho^{l,m}_X = \begin{cases} \max\left\{ICC^{l,m}_X, \lambda\left(10^{\frac{CLD^{l,m}_X}{20}} + 10^{\frac{-CLD^{l,m}_X}{20}}\right)\right\} & , m < resBands_X \\ ICC^{l,m}_X & , \text{otherwise} \end{cases}$$

$$\theta_1^{l,m} = OPD^{l,m}_{left}$$

$$\theta_2^{l,m} = OPD^{l,m}_{left} - IPD^{l,m}$$

In a right side of Equation 1, characteristics of a trigonometric function may be used to preserve energy when a main signal is separated from a reverberation signal based on an ICC. Additionally, a left side of Equation 1 where a phase change is applied may be used to obtain a phase difference between a down-mixed mono signal and left and right signals using a phase of the down-mixed mono signal, the IPD and the OPD. Accordingly, the phase may be shifted by the phase difference.

Additionally, the OPD may be calculated through estimation as given in the following Equation 2:

[Equation 2]

$$OPD^{l,m}_{left} = \begin{cases} 0 & \text{if } (IPD^{l,m} = \pi \,\&\&\, CDL^{l,m} == 0) \\ \arctan\left(\frac{c_2^{l,m}\sin(IPD^{l,m})}{c_1^{l,m} + c_2^{l,m}\cos(IPD^{l,m})}\right), & \text{otherwise} \end{cases}$$

Furthermore, the IPD and the ICC may be determined by the following Equation 3:

[Equation 3]

$$IPD^{l,m} = \angle\langle l, r\rangle$$

$$ICC^{l,m}_x = \frac{|\langle l, r\rangle|}{\|l\| \cdot \|r\|}$$

The audio signal encoding apparatus 103 may encode a main signal M of the multi-channel audio signal that is derived through the down-mixing apparatus 101. Here, the audio signal encoding apparatus 103 may also encode a residual signal Res derived through the down-mixing.

The spatial parameter encoding apparatus 104 may encode the spatial parameter based on a correlation between spatial parameters that are extracted by the spatial parameter extracting apparatus 102.

The multiplexing apparatus 105 may generate a bitstream by multiplexing the encoded main signal M, the encoded residual signal Res, and the encoded spatial parameter. The generated bitstream may be transferred to a decoding apparatus of FIG. 2.

The spatial parameter encoding apparatus 104 will be further described with reference to FIG. 3.

Figure 2:
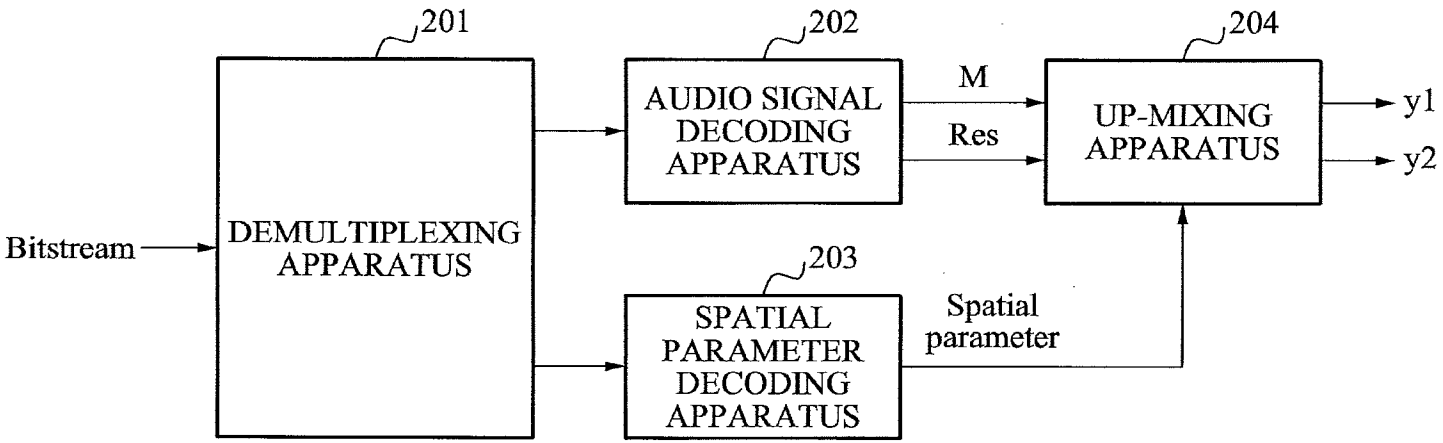
FIG. 2 illustrates a block diagram of apparatuses used to decode a multi-channel audio signal according to one or more embodiments.

FIG. 2 illustrates a block diagram of apparatuses used to decode a multi-channel audio signal according to one or more embodiments.

Referring to FIG. 2, the multi-channel audio signal may be decoded through a demultiplexing apparatus 201, an audio signal decoding apparatus 202, a spatial parameter decoding apparatus 203, and an up-mixing apparatus 204.

The demultiplexing apparatus 201 may demultiplex the bitstream, and may extract the encoded main signal M, the encoded residual signal Res, and the encoded spatial parameter from the demultiplexed bitstream.

The audio signal decoding apparatus 202 may decode the extracted main signal M and the extracted residual signal Res, and may transfer the decoded main signal M and the decoded residual signal Res to the up-mixing apparatus 204.

The spatial parameter decoding apparatus 203 may decode the extracted spatial parameter using the correlation, and may transfer the decoded spatial parameter to the up-mixing apparatus 204.

The up-mixing apparatus 204 may up-mix the main signal M using the spatial parameter. For example, when the main signal M is a mono signal, the up-mixing apparatus 204 may up-mix the main signal M, to generate a stereo signal with two channels y1 and y2.

The spatial parameter decoding apparatus 203 will be further described with reference to FIG. 4.

Figure 3:
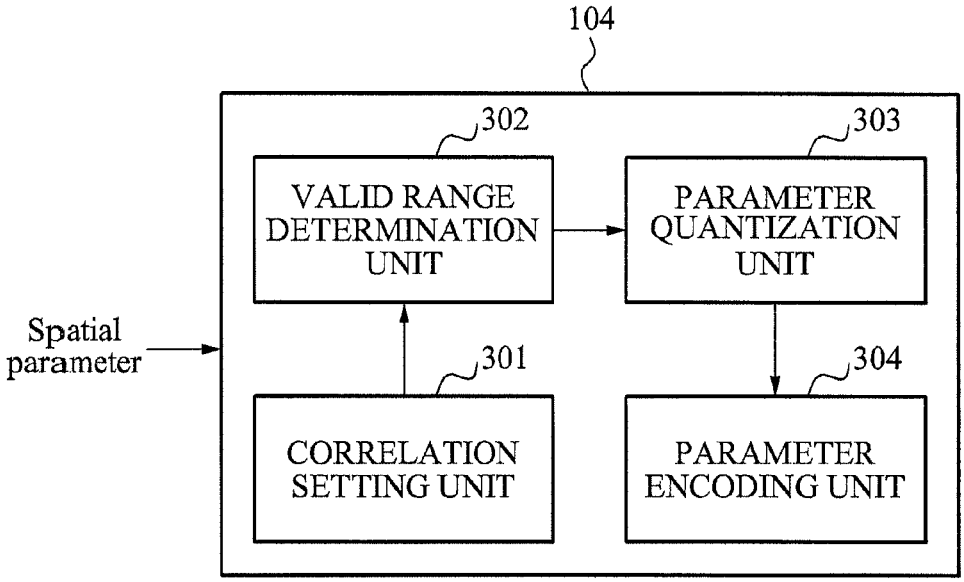
FIG. 3 illustrates a block diagram of a configuration of a spatial parameter encoding apparatus of FIG. 1.

FIG. 3 illustrates a block diagram of a configuration of the spatial parameter encoding apparatus 104 of FIG. 1.

Referring to FIG. 3, the spatial parameter encoding apparatus 104 may include a correlation setting unit 301, a valid range determination unit 302, a parameter quantization unit 303, and a parameter encoding unit 304.

The correlation setting unit 301 may determine whether input spatial parameters correlate with each other. When the input spatial parameters have no correlation with each other, the correlation setting unit 301 may optionally set a correlation with respect to corresponding spatial parameters. Conversely, when the input spatial parameters correlate with each other, the spatial parameters may be input to the valid range determination unit 302, not to the correlation setting unit 301.

The valid range determination unit 302 may determine a valid range of a spatial parameter using a correlation between spatial parameters indicating a characteristic relationship between channels of the multi-channel audio signal. Here, the valid range of the spatial parameter refers to a range of values of each parameter due to a correlation between two spatial parameters.

The spatial parameter may include, for example, an ICC, and an IPD. As described above, the spatial parameter may also include a CLD, and an OPD. Hereinafter, descriptions will be given based on the ICC and the IPD.

According to one or more embodiments, it is possible to more efficiently process a spatial parameter using a correlation between spatial parameters. Specifically, when a single spatial parameter is determined using a correlation between spatial parameters, a quantization may be performed by processing another spatial parameter using a condition expression corresponding to the correlation.

The ICC may be defined as given in Equation 4 by taking only a real number of a complex number, or may be expressed by a positive real number as an absolute value of the complex number, as given in Equation 5.

$$ICC_{Re} = \frac{\mathrm{Re}\langle l, r\rangle}{\|l\| \cdot \|r\|} = \frac{|\langle l, r\rangle|\cos(IPD)}{\|l\| \cdot \|r\|} \quad \text{[Equation 4]}$$

$$ICC_{abs} = \frac{|\langle l, r\rangle|}{\|l\| \cdot \|r\|} \quad \text{[Equation 5]}$$

In Equations 4 and 5, / denotes a left-channel signal in a stereo signal, and r denotes a right-channel signal in the stereo signal. Additionally, IPD denotes a phase difference between channels, and <I,r> denotes a dot product of the left-channel signal and the right-channel signal.

When the ICC is defined as the real number of the complex number, as given in Equation 4, phase encoding and decoding may not be performed using the IPD. Additionally, when the ICC is defined as the absolute value of the complex number, as given in Equation 5, phase encoding and decoding may be performed using the IPD.

In an example, the valid range determination unit 302 may determine a valid range of an ICC for real numbers ($ICC_{Re}$). In another example, the valid range determination unit 302 may determine a valid range of an ICC for absolute values ($ICC_{abs}$), and a valid range of an ICC for signs $(ICC)_{sign}$ to which a sign of the IPD is applied.

Referring to Equations 4 and 5, the $ICC_{abs}$ may be obtained by applying a trigonometric function value "cos(IPD)" of the IPD to the $ICC_{Re}$. Accordingly, the ICC and the IPD may partially correlate with each other, and may include overlapping information. The $ICC_{Re}$ may have a value from "−1" to "1", and the IPD may have a value from "0" to "2π".

Here, when the IPD is in a range of "0" to "π/2" and a range of "3π/2" to "2π", "cos(IPD)" may have a positive value based on a characteristic of a trigonometric function. Additionally, when the IPD is in a range of "π/2" to "3π/2", "cos(IPD)" may have a negative value. Referring to Equation 1 representing a relationship between $ICC_{Re}$ and the IPD, a sign of the $ICC_{Re}$ may be determined based on a sign of "cos(IPD)". Conversely, the sign of "cos(IPD)" may be determined based on the sign of the $ICC_{Re}$, and accordingly a valid range of available values in the IPD may be determined.

Thus, according to one or more embodiments, since "cos (IPD)" correlates with the ICC, the valid range may be determined by a single spatial parameter. Accordingly, when different quantization operations are performed, the spatial parameter may be efficiently encoded and/or decoded. For example, when the $ICC_{Re}$ has a value of "−1", the $ICC_{abs}$ may have a value equal to or less than "1". Accordingly, "cos (IPD)" may have a negative value equal to or less than "−1". As a result, the $ICC_{abs}$ may have a value of "1", the IPD may have a value of "π", and both the "cos(IPD)" and the ICC may satisfy the correlation.

When an interval of the ICC and an interval of the IPD are extended using the above-described conditions, and when the $ICC_{Re}$ is in a predetermined interval, the IPD needs to be included in an interval determined based on a correlation between the IPD and the $ICC_{Re}$, so that a condition expression corresponding to the correlation may be established. According to one or more embodiments, a quantization interval of spatial parameters may be set using a condition expression corresponding to a correlation between the spatial parameters, and may efficiently encode using the quantization interval.

The correlation between the ICC and the IPD may be defined as given in Equation 6 below, by summarizing the above-described conditions.

[Equation 6]

$$ICC_{Re} \geq 0, \text{ if } |IPD| \leq \frac{\pi}{2} \quad \text{(Condition 1)}$$

$$ICC_{Re} < 0, \text{ if } |IPD| > \frac{\pi}{2} \quad \text{(Condition 2)}$$

$$ICC_{abs} = \sqrt{ICC_{Re}^2 + ICC_{Im}^2} \leq 1\left(\text{if, } ICC_{Im} = \frac{\text{Im}\langle l, r\rangle}{\|l\| \cdot \|r\|}\right) \quad \text{(Condition 3)}$$

When all conditions 1, 2 and 3 of Equation 6 are not satisfied, the $ICC_{Re}$ and the IPD may not exist. Accordingly, the spatial parameter encoding apparatus 104 may efficiently quantize a spatial parameter, except that Equation 6 is not satisfied.

The parameter quantization unit 303 may quantize the spatial parameter based on the valid range. For example, the parameter quantization unit 303 may quantize the spatial parameter using a joint quantization table including the valid range of the spatial parameter based on the correlation between the spatial parameters. In other words, the joint quantization table may be used to express both the $ICC_{Re}$ and the IPD that satisfy Equation 6.

Values of an IPDQ and an ICCQ that are used in reference software of USAC WD7, and boundary values IPDB and ICCB thereof are given as follows:

IPDQ=[0,π/4,π/2,3π/4,π,5π/4,3π/2,7π/4]

IPDB=[(0),π/8,3π/8,5π/8,7π/8,9π/8,11π/8,13π/8,(2π)]

*ICCQ*=[1.0000,0.9370,0.84118,0.60092,0.36764, 0.0,−0.5890,−0.9900]

*ICCB*=[(1),0.9685,0.88909,0.72105,0.48428, 0.18382,−0.2945,−0.7895,(−1)]

Since the IPD does not need to depend on a predetermined value, the parameter quantization unit 303 may uniformly quantize the IPD. Here, the term "uniformly" refers to regular intervals of the IPD. Additionally, the valid range of the ICC may be experimentally determined.

The parameter quantization unit 303 may generate a joint quantization table with respect to two spatial parameters, by setting a use of only a minimum quantization step based on the valid range. For example, a joint quantization table may be generated by at least changing an ICC and an ICCB while maintaining an IPD and an IPDB to be the same. Specifically, the parameter quantization unit 303 may generate a joint quantization table based on the following Equation 7:

[Equation 7]

$$0 \leq ICC_{Re} \leq \cos(IPD), \text{ if } |IPD| \leq \frac{\pi}{2}$$

$$\cos(IPD) \leq ICC_{Re} < 0, \text{ if } |IPD| > \frac{\pi}{2}$$

In Equation 7, when an IPD is in a predetermined range, a valid scope of an ICC may be determined.

The parameter quantization unit 303 may determine a boundary value of a main ICC (ICCB2) using Equation 7 and "cos(IPDB)", to obtain the following results:

cos(IPDB)=[(1),0.9239,0.3827,−0.3827,−0.9239,−0.9239,−0.3827,0.3827,0.9239,(1)]

*ICCB2*=[(1),0.9239,0.3827,0,−0.3827,−0.9239,(−1)]

When an absolute value of a boundary value of an ICC is less than values of an ICCB2, namely "0.9239" and "0.3827", a number of quantization steps may be increased. For example, when an IPDQ has a value of "π/4", a corresponding cos(IPDB) may be "[0.9239, 0.3827]", and a value of an $ICC_{Re}$ may need to be greater than "0" and less than "0.9239". Accordingly, the value of the $ICC_{Re}$ may not be greater than "0.9239".

Result values of an ICCQ' and an ICCB' obtained by the above scheme may be given as follow:

*ICCQ'*=[1.0000,0.9370,0.84118,0.60092,0.1676,−0.1676,−0.5978,−0.9900]

*ICCB'*=[(1),0.9685,0.88909,0.72105,0.3843,0.0,−0.3827,−0.7939,(−1)]

When a new quantization step based on the result values of the ICCQ' and ICCB' is used, the following advantages may be provided. First, when an ICCQ has a value of "0", IPDQ needs to have all values. However, since it is impossible for the ICCQ to have a value of "0" based on the result values of the ICCQ' and ICCB', a number of quantization steps may be reduced. Second, a corresponding ICCQ may be set to have values of "0.1676", "−0.1676", "−0.5978" so that an absolute value of the ICCB may not be less than "0.3827" and accordingly, a number of quantization steps for ICCQ values may be reduced. For example, when a value of "−0.5890" is used, the IPDB may have a value of "−0.3783", five quantization steps may be required, instead of three quantization steps. As described above, when a joint quantization table is generated using a correlation between spatial parameters, encoding may be efficiently performed in view of a quantization step.

Table 1, as a joint quantization table, shows a valid range and a quantization step based on a correlation between an IPD and an $ICC_{Re}$.

TABLE 1

| | $ICC_{Re}$ | | | | | | | |
|---|---|---|---|---|---|---|---|---|
| IPD | 1.0 | 0.93 | 0.8412 | 0.6009 | 0.1676 | −0.1676 | −0.5978 | −0.99 |
| 0 | 0 | 0 | 0 | 0 | 0 | X | X | X |
| π/4 | X | 1 | 1 | 1 | 1 | X | X | X |
| π/2 | X | X | X | X | 2 | 0 | X | X |
| 3π/4 | X | X | X | X | X | 1 | 0 | 0 |
| π | X | X | X | X | X | 2 | 1 | 1 |
| 5π/4 | X | X | X | X | X | 3 | 2 | 2 |
| 3π/2 | X | X | X | X | 3 | 4 | X | X |
| 7π/4 | X | 2 | 2 | 2 | 4 | X | X | X |

In Table 1, an "X" indicates impossibility of existence of each spatial parameter based on the correlation between the IPD and the $ICC_{Re}$. As a result, conditions of Equation 3 and 4 representing the correlation between the IPD and the $ICC_{Re}$ may be defined as a set of inequalities.

The parameter quantization unit 303 may set a valid range of a spatial parameter based on an intersection of inequalities, and may efficiently quantize the spatial parameter. Accordingly, a number of quantization operations based on a valid range of an ICC and a valid range of an IPD may be reduced to at least half. Additionally, when a Decoded ICC (DQICC)

has a value of "1", a Decoded IPD (DQIPD) may have a value of "0" at all times, and accordingly there is no need to transmit a single result value to a decoding apparatus.

For example, when an IPD is quantized using two values, namely "0" and "Tr" as shown in Table 2, the IPD may be determined by a sign of an $ICC_{Re}$. In other words, since the IPD is determined based on the sign of the $ICC_{Re}$, there is no need to transmit the IPD to a decoding apparatus. Additionally, during a quantization step, when an $ICC_{Re}$ has a value of "0", whether a value of the IPD is set to be "0" or "1" may need to be determined in advance.

TABLE 2

| | $ICC_{Re}$ | | | | | | | |
|---|---|---|---|---|---|---|---|---|
| IPD | 1.0 | 0.93 | 0.8412 | 0.6009 | 0.36764 | 0 | −0.5890 | −0.99 |
| 0 | 0 | 0 | 0 | 0 | 0 | 0 | X | X |
| π | X | X | X | X | X | X | 0 | 0 |

Table 3, as a joint quantization table, shows a valid range and a quantization step based on a correlation between an IPD and an $ICC_{abs}$. Here, an $ICC_{abs}$ and an $ICC_{sign}$ may be used as an ICC.

TABLE 3

| | $ICC_{sign}$ | | | | | | | |
|---|---|---|---|---|---|---|---|---|
| IPD | 1.0 | 0.93 | 0.8412 | 0.6009 | 0.1676 | −0.1676 | −0.5978 | −0.99 |
| 0 | 0 | 0 | 0 | 0 | 0 | X | X | X |
| π/4 | 1 | 1 | 1 | 1 | 1 | X | X | X |
| π/2 | X | X | X | X | X | 0 | 0 | 0 |
| 3π/4 | X | X | X | X | X | 1 | 1 | 1 |
| π | X | X | X | X | X | 2 | 2 | 2 |
| 5π/4 | X | X | X | X | X | 3 | 3 | 3 |
| 3π/2 | 2 | 2 | 2 | 2 | 2 | X | X | X |
| 7π/4 | 3 | 3 | 3 | 3 | 3 | X | X | X |

As shown in Table 3, compared with using the $ICC_{Re}$, using the $ICC_{abs}$ in phase encoding and decoding may be advantageous in a sound quality, despite a large amount of data not being reduced. The $ICC_{sign}$ may be defined as given in the following Equation 8:

$$ICC_{sign} = ICC_{abs} \cdot sgn(\cos(IPD)) \quad \text{[Equation 8]}$$

$$\text{sgn}(\cos(IPD)) = 1, \text{ If } IPD < \frac{\pi}{2}, IPD \geq \frac{3\pi}{2} \quad \text{(Condition 4)}$$

$$\text{sgn}(\cos(IPD)) = -1, \text{ If } \frac{\pi}{2} \leq IPD < \frac{3\pi}{2} \quad \text{(Condition 5)}$$

An $ICC_{sign}$ where a sign of "cos(IPD)" is reflected may be obtained using Equation 8. For example, quantization may be performed by optionally setting a predetermined correlation with respect to spatial parameters, even when the spatial parameters have no correlation with each other. Additionally, there is almost no recognizable change in sound quality, while joint entropy is reduced.

As shown in Table 3 and Equation 8, the sign of "cos(IPD)" is reflected and accordingly, quantization may be performed using the IPD in half the number of cases. When the sign of "cos(IPD)" is inclined to either "+" or "−", a quantization interval may be determined so that a greater number of quantization steps of an ICC may be provided to a side where the sign of "cos(IPD)" is inclined. Such a scheme may enable a data amount to be reduced, and simultaneously enable a same sound quality to be realized. Additionally, when an IPD is quantized using only two values, the IPD may be determined by a sign of an $ICC_{sign}$, as shown in Table 4 below. In other words, since the IPD is determined based on only the sign of the $ICC_{sign}$, there is no need to transmit the IPD to a decoding apparatus.

TABLE 4

| | $ICC_{sign}$ | | | | | | | |
|---|---|---|---|---|---|---|---|---|
| IPD | 1.0 | 0.93 | 0.8412 | 0.6009 | 0.1676 | −0.1676 | −0.5978 | −0.99 |
| 0 | 0 | 0 | 0 | 0 | 0 | X | X | X |
| π | X | X | X | X | X | 0 | 0 | 0 |

The parameter encoding unit 304 may encode the quantized spatial parameter. The encoded spatial parameter may be transferred to a decoding apparatus, and may be used to up-mix the down-mixed multi-channel audio signal.

Figure 4:
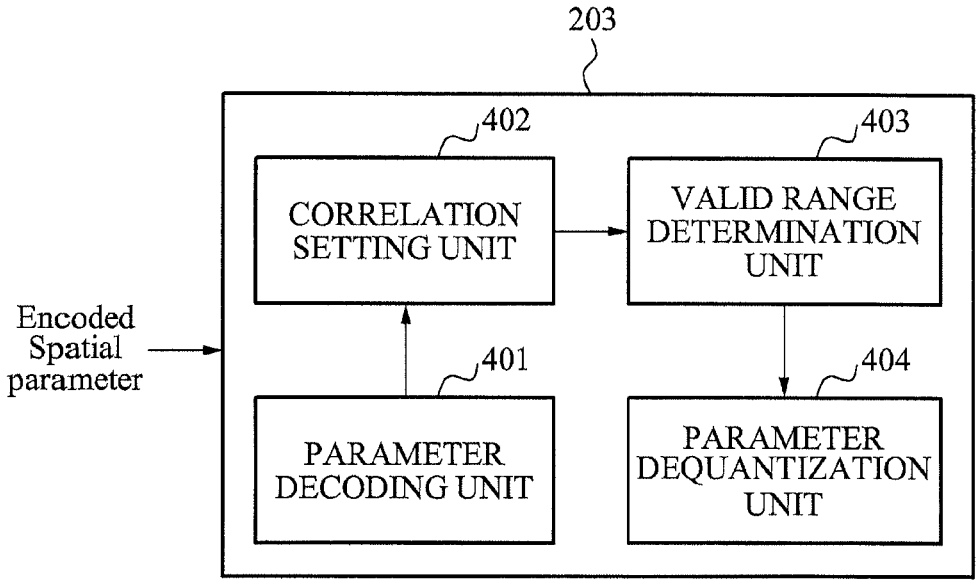
FIG. 4 illustrates a block diagram of a configuration of a spatial parameter decoding apparatus of FIG. 2.

FIG. 4 illustrates a block diagram of a configuration of the spatial parameter decoding apparatus 203 of FIG. 2.

Referring to FIG. 4, the spatial parameter decoding apparatus 203 may include a parameter decoding unit 401, a correlation setting unit 402, a valid range determination unit 403, and a parameter dequantization unit 404.

The parameter decoding unit 401 may decode the encoded spatial parameter in the bitstream. Here, the spatial parameter may include an ICC and an IPD.

The correlation setting unit 402 may determine whether spatial parameters correlate with each other. The correlation setting unit 402 may set a correlation with respect to spatial parameters having no correlation with each other.

The valid range determination unit 403 may determine a valid range of a spatial parameter using a correlation between spatial parameters indicating a characteristic relationship between channels of a multi-channel audio signal. In an example, the valid range determination unit 403 may determine a valid range of an $ICC_{Re}$. In another example, the valid range determination unit 403 may determine a valid range of an $ICC_{abs}$, and a valid range of an $ICC_{sign}$.

The parameter dequantization unit 404 may dequantize the spatial parameter based on the valid range. For example, the parameter dequantization unit 404 may dequantize the spatial parameter using a joint dequantization table including the valid range of the spatial parameter based on the correlation. Specifically, the parameter dequantization unit 404 may dequantize the spatial parameter using a joint dequantization table corresponding to Tables 1 through 4 that are described with reference to FIG. 3. In an example, a value of an $ICC_{sign}$ obtained by Table 4 is based on a correlation that is set on demand, and accordingly the value of $ICC_{sign}$ may need to be changed to a value of $ICC_{abs}$ after the IPD is dequantized. The value of the $ICC_{sign}$ may be changed using an equation "$ICC_{abs}=|ICC_{sign}|$" that invalidates the set correlation.

In another example, a value of an $ICC_{Re}$ obtained by Table 1 is may be used without a change. However, since phase information may be processed by an IPD, there is no need to use the $ICC_{Re}$ without a change. Accordingly, an $ICC_{abs}$ may be estimated using an $ICC_{Re}$ and an IPD (for example, $ICC_{abs}=ICC_{Re}/\cos(IPD)$), or a value of "$|ICC_{Re}|$" may be used as a correlation parameter.

Figure 5A:
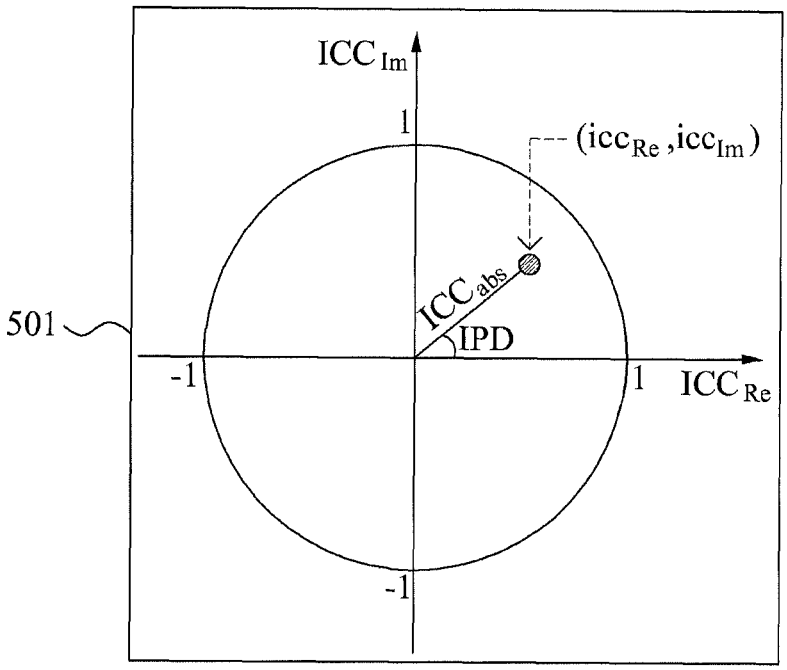
FIG. 5A illustrates a diagram of a correlation between spatial parameters.
Figure 5B:
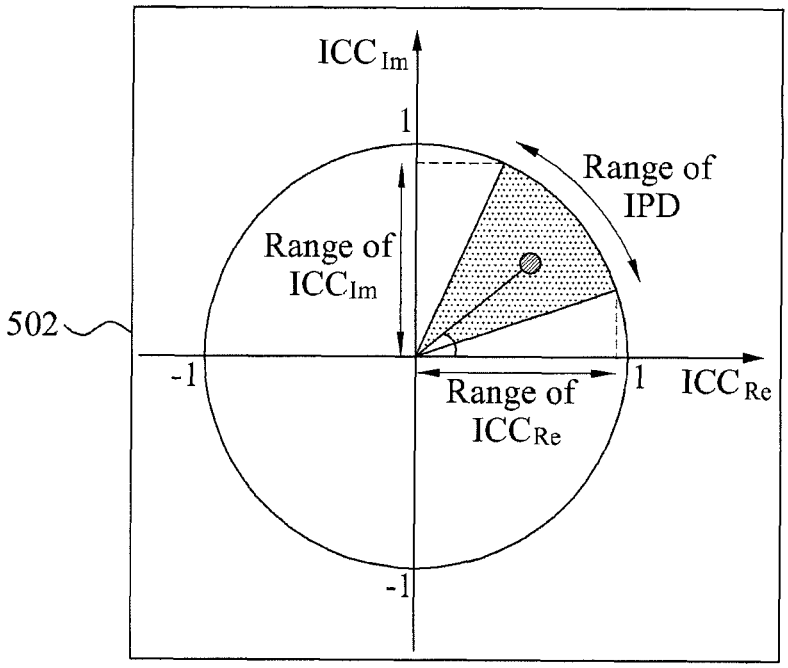
FIG. 5B illustrates a valid range based on the correlation according to one or more embodiments.

FIG. 5A illustrates a diagram of a correlation between spatial parameters, and FIG. 5B illustrates a valid range based on the correlation according to one or more embodiments.

In FIG. 5A, a graph 501 illustrates a correlation between an ICC and an IPD, and may be expressed by Equations 4 and 5.

An $ICC_{abs}$ may be determined by an $ICC_{Re}$, and an ICC for imaginary numbers ($ICC_{Im}$). Additionally, the IPD may refer to a phase determined by an $ICC_{abs}$.

Additionally in FIG. 5B, a graph 502 illustrates a valid range of an ICC, and a valid range of an IPD based on a correlation between the ICC and the IPD, and may be expressed by Equations 6 and 7. For example, when an $ICC_{Re}$ is determined, a range of the IPD may be determined due to the correlation. In graph 502, a shaded portion indicates the valid range of the ICC, and the valid range of the IPD. In other words, when the IPD is in a predetermined range, the valid range of the ICC may be determined based on the correlation between the ICC and the IPD.

Figure 6:
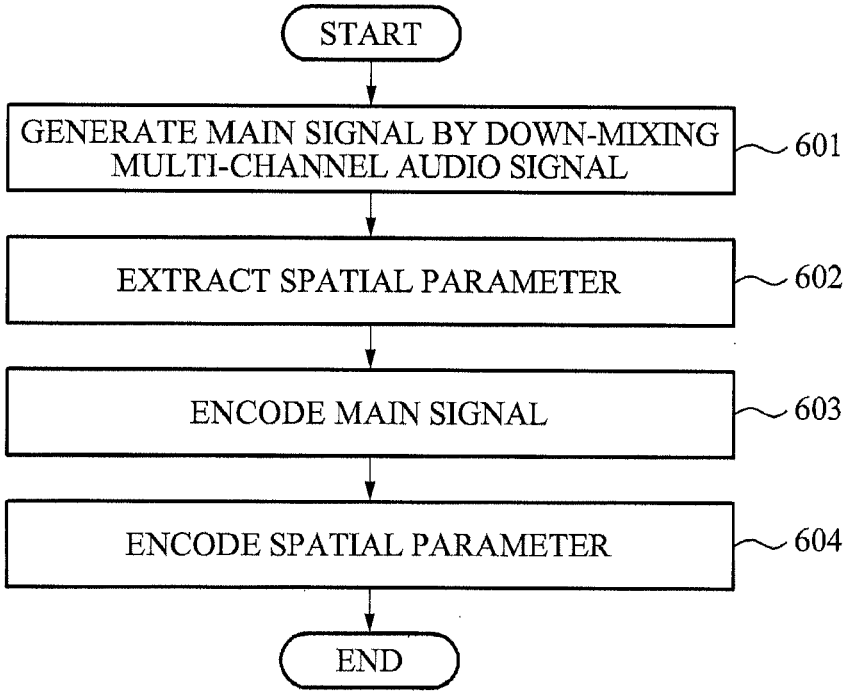
FIG. 6 illustrates a flowchart of a method of encoding a multi-channel audio signal according to one or more embodiments.

FIG. 6 illustrates a flowchart of a method of encoding a multi-channel audio signal according to one or more embodiments.

In operation 601, the down-mixing apparatus 101 may generate a main signal by down-mixing the multi-channel audio signal. For example, when the multi-channel audio signal is a stereo signal, the down-mixing apparatus 101 may down-mix the stereo signal to generate a mono signal.

In operation 602, the spatial parameter extracting apparatus 102 may extract a spatial parameter indicating a characteristic relationship between channels of the multi-channel audio signal.

In operation 603, the audio signal encoding apparatus 103 may encode the main signal.

In operation 604, the spatial parameter encoding apparatus 104 may encode the spatial parameter based on a correlation between spatial parameters.

Finally, the multiplexing apparatus 105 may generate a bitstream using the encoded main signal and the encoded spatial parameter.

Figure 7:
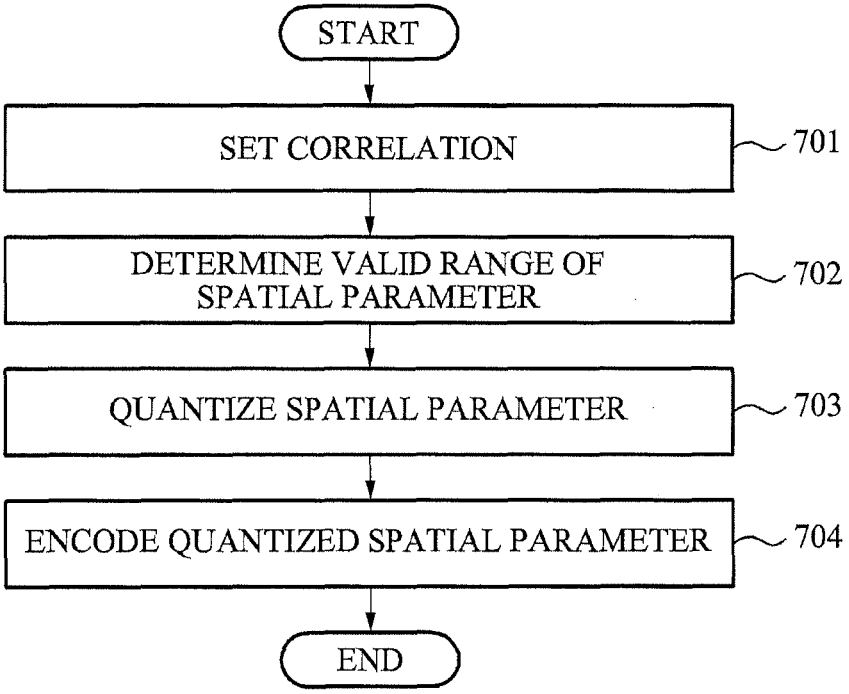
FIG. 7 illustrates a flowchart of an operation of encoding a spatial parameter in the method of FIG. 6.

FIG. 7 illustrates a flowchart of operation 604 of FIG. 6.

The spatial parameter encoding apparatus 104 may determine whether spatial parameters correlate with each other. In operation 701, the spatial parameter encoding apparatus 104 may set a correlation with respect to spatial parameters having no correlation with each other.

In operation 702, the spatial parameter encoding apparatus 104 may determine a valid range of the spatial parameter using the correlation between spatial parameters. Here, the spatial parameter may include, for example, an ICC and an IPD. In an example, the spatial parameter encoding apparatus 104 may determine a valid range of an $ICC_{Re}$. In another example, the spatial parameter encoding apparatus 104 may determine a valid range of an $ICC_{abs}$, and a valid range of an $ICC_{sign}$.

In operation 703, the spatial parameter encoding apparatus 104 may quantize the spatial parameter based on the valid range of the spatial parameter. For example, the spatial parameter encoding apparatus 104 may quantize the spatial parameter using a joint quantization table including the valid range of the spatial parameter based on the correlation between the spatial parameters. Specifically, the spatial parameter encoding apparatus 104 may quantize the spatial parameter using a joint quantization table corresponding to Tables 1 through 4.

In operation 704, the spatial parameter encoding apparatus 104 may encode the quantized spatial parameter.

Figure 8:
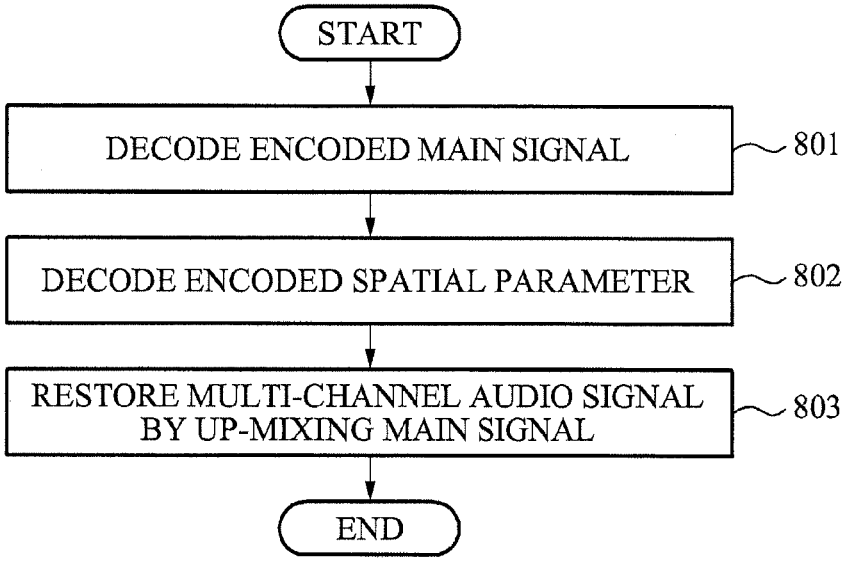
FIG. 8 illustrates a flowchart of a method of decoding a multi-channel audio signal according to one or more embodiments.

FIG. 8 illustrates a flowchart of a method of decoding a multi-channel audio signal according to one or more embodiments.

The demultiplexing apparatus 201 may demultiplex a bitstream, and may extract an encoded main signal, and an encoded spatial parameter from the demultiplexed bitstream.

In operation 801, the audio signal decoding apparatus 202 may decode the encoded main signal.

In operation 802, the spatial parameter decoding apparatus 203 may decode the encoded spatial parameter using a correlation between spatial parameters.

In operation 803, the up-mixing apparatus 204 may restore the multi-channel audio signal by up-mixing the main signal using the spatial parameter.

Figure 9:
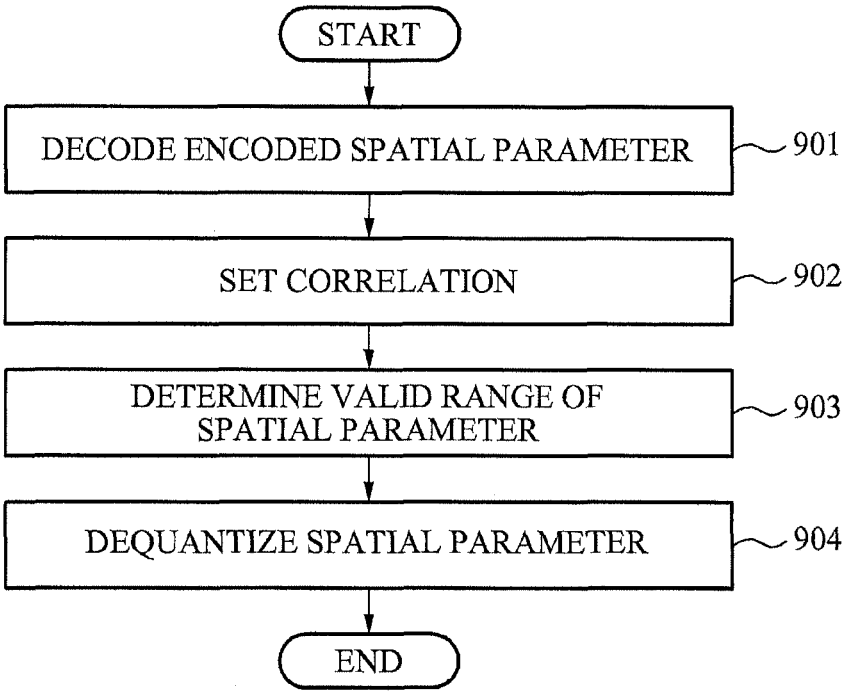
FIG. 9 illustrates a flowchart of an operation of decoding a spatial parameter in the method of FIG. 8.

FIG. 9 illustrates a flowchart of operation 802 of FIG. 8.

In operation 901, the spatial parameter decoding apparatus 203 may decode the encoded spatial parameter.

The spatial parameter decoding apparatus 203 may determine whether spatial parameters correlate with each other. In operation 902, the spatial parameter decoding apparatus 203 may set a correlation with respect to spatial parameters having no correlation with each other.

In operation 903, the spatial parameter decoding apparatus 203 may determine a valid range using the correlation between the spatial parameters. In an example, the spatial parameter decoding apparatus 203 may determine a valid range of an $ICC_{Re}$. In another example, the spatial parameter decoding apparatus 203 may determine a valid range of an $ICC_{abs}$, and a valid range of an $ICC_{sign}$.

In operation 904, the spatial parameter decoding apparatus 203 may dequantize the spatial parameter based on the valid range of the spatial parameter. For example, the spatial parameter decoding apparatus 203 may dequantize the spatial parameter using a joint dequantization table including the valid range of the spatial parameter based on the correlation between the spatial parameters. Specifically, the spatial parameter decoding apparatus 203 may dequantize the spatial parameter using a joint dequantization table corresponding to Tables 1 through 4 that are described with reference to FIG. 3.

The methods according to the above-described embodiments may be recorded in non-transitory computer-readable media including computer readable instructions such as a computer program to implement various operations by executing computer readable instructions to control one or more processors, which are a part of a general purpose computer, computing device, a computer system, or a network. The media may also have recorded thereon, alone or in combination with the computer readable instructions, data files, data structures, and the like. The computer readable instructions recorded on the media may be those specially designed and constructed for the purposes of embodiments, or they may be of the kind well-known and available to those having skill in the computer software arts. Examples of computer-readable media include magnetic media such as hard disks, floppy disks, and magnetic tape; optical media such as CD ROM disks and DVDs; magneto-optical media such as optical disks; and hardware devices that are specially configured to store and perform program instructions, such as read-only memory (ROM), random access memory (RAM), flash memory, and the like. The computer-readable media may also be a distributed network, so that the program instructions are stored and executed in a distributed fashion. The program instructions may be executed by one or more processors. The computer-readable media may also be embodied in at least one application specific integrated circuit (ASIC) or Field Programmable Gate Array (FPGA), which executes (processes like a processor) program instructions. Examples of program instructions include both machine code, such as produced by a compiler, and files containing higher level code that may be executed by the computer using an interpreter. The above-described devices may be configured to act as one or more software modules in order to perform the operations of the above-described embodiments, or vice versa. Another example of media may also be a distributed network, so that the computer readable instructions are stored and executed in a distributed fashion.

Although embodiments have been shown and described, it would be appreciated by those skilled in the art that changes may be made in these embodiments without departing from the principles and spirit of the disclosure, the range of which is defined in the claims and their equivalents.

What is claimed is:

1. A spatial parameter encoding apparatus, comprising:

a valid range determination unit to determine a valid range of a spatial parameter using a correlation between input spatial parameters indicating a characteristic relationship between channels of a multi-channel audio signal;

a parameter quantization unit to quantize the spatial parameter based on the valid range; and a parameter encoding unit to encode the quantized spatial parameter using at least one processor, wherein the spatial parameter comprises an Inter-Channel Correlation (ICC) and an Inter-channel Phase Difference (IPD), and wherein the correlation indicates a correlation between the ICC and the IPD.

2. The spatial parameter encoding apparatus of claim 1, wherein the parameter quantization unit quantizes the spatial parameter using a joint quantization table including the valid range.

3. The spatial parameter encoding apparatus of claim 1, further comprising:

a correlation setting unit to set a correlation with respect to input spatial parameters having no correlation with each other, wherein the valid range determination unit determines the valid range based on the set correlation.

4. The spatial parameter encoding apparatus of claim 1, wherein the valid range determination unit determines a valid range of an ICC for real numbers ($ICC_{Re}$) based on an ICC for signs $(ICC)_{sign}$.

5. The spatial parameter encoding apparatus of claim 1, wherein the valid range determination unit determines a valid range of an ICC for absolute values ($ICC_{abs}$), and a valid range of an ICC for signs $(ICC)_{sign}$ to which a sign of the IPD is applied.

6. The spatial parameter encoding apparatus of claim 1, wherein, when the IPD is quantized to have two values, and is determined based on a sign of the ICC, the parameter encoding unit prevents transmitting of the IPD.

7. The spatial parameter encoding apparatus of claim 1, wherein the parameter quantization unit quantizes the spatial parameter using a joint quantization table with respect to two input spatial parameters, by setting a use of only a minimum quantization operation based on the valid range.

8. The spatial parameter encoding apparatus of claim 1, wherein the parameter quantization unit sets the valid range of the spatial parameter using a joint quantization table based on an intersection of inequalities to quantize the spatial parameter.

9. A spatial parameter decoding apparatus, comprising:

a spatial parameter decoding unit to decode an encoded spatial parameter;

a valid range determination unit to determine a valid range of a spatial parameter using a correlation between input spatial parameters indicating a characteristic relationship between channels of a multi-channel audio signal; and a parameter dequantization unit to dequantize the spatial parameter based on the valid range using at least one processor, wherein the spatial parameter comprises an Inter-Channel Correlation (ICC) and an Inter-channel Phase Difference (IPD), and wherein the correlation indicates a correlation between the ICC and the IPD.

10. The spatial parameter decoding apparatus of claim 9, wherein the parameter dequantization unit dequantizes the spatial parameter using a joint dequantization table including the valid range.

11. The spatial parameter decoding apparatus of claim 9, further comprising:

a correlation setting unit to set a correlation with respect to input spatial parameters having no correlation with each other, wherein the valid range determination unit determines the valid range based on the set correlation.

12. The spatial parameter decoding apparatus of claim 9, wherein the valid range determination unit determines a valid range of an ICC for real numbers ($ICC_{Re}$).

13. The spatial parameter decoding apparatus of claim 9, wherein the valid range determination unit determines a valid range of an ICC for absolute values ($ICC_{abs}$), and a valid range of an ICC for signs $(ICC)_{sign}$ to which a sign of the IPD is applied.

14. A spatial parameter encoding method, comprising:

determining a valid range of a spatial parameter using a correlation between spatial parameters indicating a characteristic relationship between channels of a multi-channel audio signal;

quantizing the spatial parameter based on the valid range; and encoding the quantized spatial parameter using at least one processor, wherein the spatial parameter comprises an Inter-Channel Correlation (ICC) and an Inter-channel Phase Difference (IPD), and wherein the correlation indicates a correlation between the ICC and the IPD.

15. The spatial parameter encoding method of claim 14, wherein the quantizing comprises quantizing the spatial parameter using a joint quantization table including the valid range.

16. The spatial parameter encoding method of claim 14, further comprising:

setting a correlation with respect to input spatial parameters having no correlation with each other, wherein the determining comprises determining the valid range based on the set correlation.

17. The spatial parameter encoding method of claim 14, wherein the determining comprises determining a valid range of an ICC for real numbers ($ICC_{Re}$).

18. The spatial parameter encoding method of claim 14, wherein the determining comprises determining a valid range of an ICC for absolute values ($ICC_{abs}$), and a valid range of an ICC for signs $(ICC)_{sign}$ to which a sign of the IPD is applied.

19. The spatial parameter encoding method of claim 14, wherein the encoding comprises preventing transmission of the IPD, when the IPD is quantized to have two values, and is determined based on a sign of the ICC.

20. A spatial parameter decoding method, comprising:

decoding an encoded spatial parameter;

determining a valid range of a spatial parameter using a correlation between input spatial parameters indicating a characteristic relationship between channels of a multi-channel audio signal; and dequantizing the spatial parameter based on the valid range using at least one processor, wherein the spatial parameter comprises an Inter-Channel Correlation (ICC) and an Inter-channel Phase Difference (IPD), and wherein the correlation indicates a correlation between the ICC and the IPD.

21. The spatial parameter decoding method of claim 20, wherein the dequantizing comprises dequantizing the spatial parameter using a joint dequantization table including the valid range.

22. The spatial parameter decoding method of claim 20, further comprising:

setting a correlation with respect to input spatial parameters having no correlation with each other, wherein the determining comprises determining the valid range of the spatial parameter based on the set correlation.

23. The spatial parameter decoding method of claim 20, wherein the determining comprises determining a valid range of an ICC for real numbers ($ICC_{Re}$).

24. The spatial parameter decoding method of claim 20, wherein the determining comprises determining a valid range of an ICC for absolute values ($ICC_{abs}$), and a valid range of an ICC for signs $(ICC)_{sign}$ to which a sign of the IPD is applied.

25. At least one non-transitory computer readable medium storing computer readable instructions that control at least one processor to implement the method of claim 14.

26. At least one non-transitory computer readable medium storing computer readable instructions that control at least one processor to implement the method of claim 20.

* * * * *